US007549848B2

(12) United States Patent
Scholl

(10) Patent No.: US 7,549,848 B2
(45) Date of Patent: Jun. 23, 2009

(54) DEVICE FOR ADJUSTING THE PUMPING CAPACITY OF A LUBRICANT PUMP FOR AN INTERNAL COMBUSTION ENGINE

(75) Inventor: Peter Scholl, Karlsrune (DE)

(73) Assignee: Dr. Ing. h.c.F. Porsche Aktiengesellschaft, Stuttgart (DE)

( * ) Notice: Subject to any disclaimer, the term of this patent is extended or adjusted under 35 U.S.C. 154(b) by 482 days.

(21) Appl. No.: 10/512,889

(22) PCT Filed: Jul. 1, 2003

(86) PCT No.: PCT/EP03/06971

§ 371 (c)(1),
(2), (4) Date: May 4, 2005

(87) PCT Pub. No.: WO2004/020831

PCT Pub. Date: Mar. 11, 2004

(65) Prior Publication Data

US 2005/0232785 A1 Oct. 20, 2005

(30) Foreign Application Priority Data

Aug. 28, 2002 (DE) ..... 102 39 364

(51) Int. Cl.
*F04B 49/00* (2006.01)
*F04C 14/18* (2006.01)

(52) U.S. Cl. ..... 417/220; 418/30

(58) Field of Classification Search ..... 417/220, 417/218; 418/30
See application file for complete search history.

(56) References Cited

U.S. PATENT DOCUMENTS

| | | | | |
|---|---|---|---|---|
| 2,606,503 | A * | 8/1952 | Shaw | 417/213 |
| 2,639,585 | A * | 5/1953 | Camerota | 60/376 |
| 4,780,069 | A * | 10/1988 | Dantlgraber et al. | 418/26 |
| 5,800,131 | A * | 9/1998 | Lehmann et al. | 417/220 |
| 6,790,013 | B2 * | 9/2004 | Hunter et al. | 417/220 |
| 2002/0025257 | A1 | 2/2002 | Zagranski et al. | |

FOREIGN PATENT DOCUMENTS

| | | |
|---|---|---|
| DE | 4038549 C1 | 1/1992 |
| DE | 4428410 C2 | 5/1998 |
| EP | 1043504 A2 | 10/2000 |

OTHER PUBLICATIONS

German Office Action.
International Search Report.

* cited by examiner

*Primary Examiner*—Charles G Freay
(74) *Attorney, Agent, or Firm*—RatnerPrestia

(57) ABSTRACT

A system for controlling the pumping capacity of a lubricant pump for an internal-combustion engine, having a vane cell pump (2) which has a rotor body (4), rotor blades (10) which can be radially displaced in the rotor body as well as a lifting ring (12) (stator) whose position can be adjusted with respect to the axis of rotation of the rotor for changing the delivery volume as a function of operating parameters of the internal-combustion engine. The lifting ring (12) is linked to an adjusting piston (28) guided in a valve bore (30) of a pressure regulating valve (26), which adjusting piston (28) is acted upon by engine oil pressure on a piston front side (34), the piston front side (34) being connected with the piston rear side (37) by way of a throttle bore (62).

8 Claims, 4 Drawing Sheets

DEVICE FOR ADJUSTING THE PUMPING CAPACITY OF A LUBRICANT PUMP FOR AN INTERNAL COMBUSTION ENGINE

This Application claims priority to International Patent Application No. PCT/EP03/06971, filed Jul. 1, 2003, designating the United States of America, and German Application DE 102 39364.8 filed on Aug. 28, 2002, the entire disclosure of which is incorporated herein by reference.

BACKGROUND AND SUMMARY OF THE INVENTION

The invention relates to a system for controlling the pumping capacity of a lubricant pump for an internal-combustion engine.

It is generally known, in the case of internal-combustion engines, to use rigidly driven oil pumps for supplying the oil circulating system, which oil pumps are constructed, for example, as external gear pumps or internal gear pumps or as vane cell pumps. These are oil pumps with a variable or constant delivery volume per pump wheel rotation. So-called constant-delivery pumps are equipped with a pressure limiting valve, by means of which the maximal oil pressure can be adjusted. When the oil pressure limiting valve opens at a maximal oil pressure which is set beforehand, the excess oil volume is returned into the low-pressure part of the oil pump.

Since the oil volume flow required for the lubrication of the engine is not always proportional to the rotational speed of the engine or to the rotational speed of the pump, suggestions have been made that the oil pressure be controlled in order to be able to reduce the driving power of the engine oil pump particularly in the partial load range. Thus, for example, from Japanese Patent Document JP-OS 9-885 33, a system is known for controlling the oil pressure of a gear pump in the case of which a bypass of the gear pump monitored by the pressure regulating valve can be opened or closed as a function of the pressure. For this purpose, the piston head is provided with an opening or throttle which is connected with an interior constructed on the rear side of the piston valve. A control valve is connected in front of the interior of the piston valve, by means of which control valve, the differential pressure existing between the forward and rear side of the piston valve can be changed and therefore the opening oil pressure can be adjusted.

From German Patent Document DE 43 02 610 A1, a vane cell pump is known which has a variable delivery volume and in the case of which the volume flow can be adjusted by a change of the position of the lifting ring with respect to the axis of rotation of the rotor. Furthermore, in addition to the pure maximal oil pressure limitation or of the delivery volume control, an additional limitation of the delivery volume as a function of the temperature and/or the rotational speed of the engine is suggested. For this purpose, high-expenditure temperature-dependent control elements as well as additional pressure control systems are required which, in addition to the maximal oil pressure limitation, cause an adjustment of the lifting ring of the vane cell pump and therefore, as required, a reduction of the delivered oil volume flow.

It is therefore an object of the invention to provide a system for a volume-flow-controlled vane cell pump by means of which a lubricating oil supply of the internal-combustion engine which meets the requirements takes place in a simple manner, so that the taken-up power of the oil pump can be reduced as a result of a lowering of the oil pressure in certain operating conditions.

By means of the suggested system, the driving power required for the lubricating oil supply of the internal-combustion engine in the case of a vane cell pump can be controlled in a simple manner as a function of operating parameters of the internal-combustion engine. As a result, the oil pressures required for the various operating conditions of the engine can be adjusted or adapted, so that another fuel saving potential exists because of the reduced taken-in power in comparison to an uncontrolled oil pump. The suggested system for reducing the oil pressure can be retrofitted in a simple manner in the case of vane cell pumps which are already in operation.

The force directed against the engine oil pressure on the piston rear side of the pressure regulating valve is generated by a flat coil spring which is guided and supported in a receiving opening provided on the rear side of the piston.

For the pressure-dependent controlling of the oil volume flow, a valve element is integrated in a hydraulic pipe leading from the regulating valve to the tank, by way of which regulating valve the oil flow can be adjusted which can be returned to the suction side of the oil pump.

The oil pressure or the oil volume flow delivered by the oil pump is controlled as a function of operating parameters of the internal-combustion engine, such as the rotational speed, the load or the engine oil temperature.

BRIEF DESCRIPTION OF THE DRAWINGS

An embodiment of the invention is illustrated in the drawings.

DETAILED DESCRIPTION OF THE PREFERRED EMBODIMENT

Figure 1:
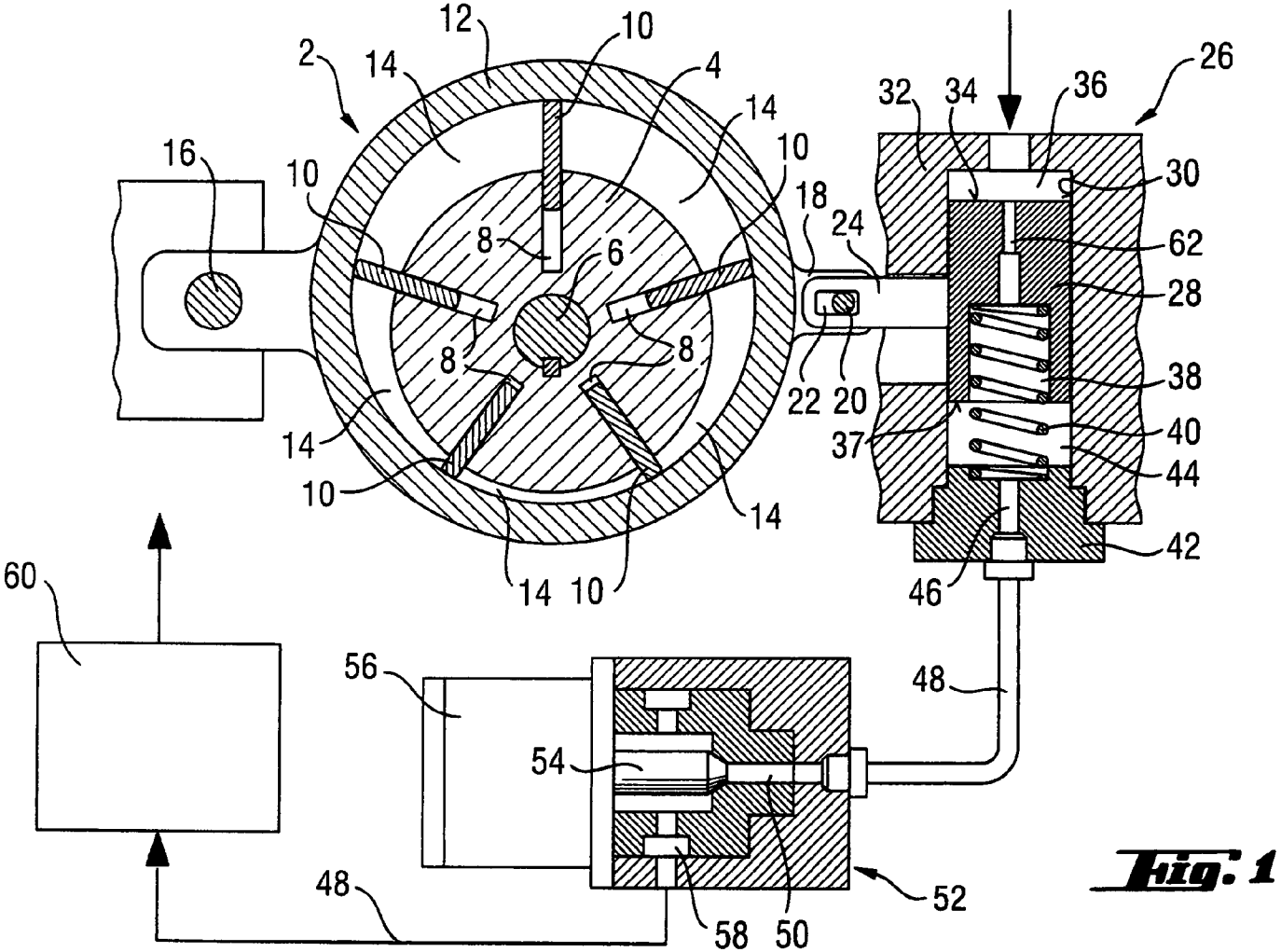
FIG. 1 is an overall schematic view of a system for controlling the pumping capacity of a vane cell pump in a first operating position.
Figure 2:
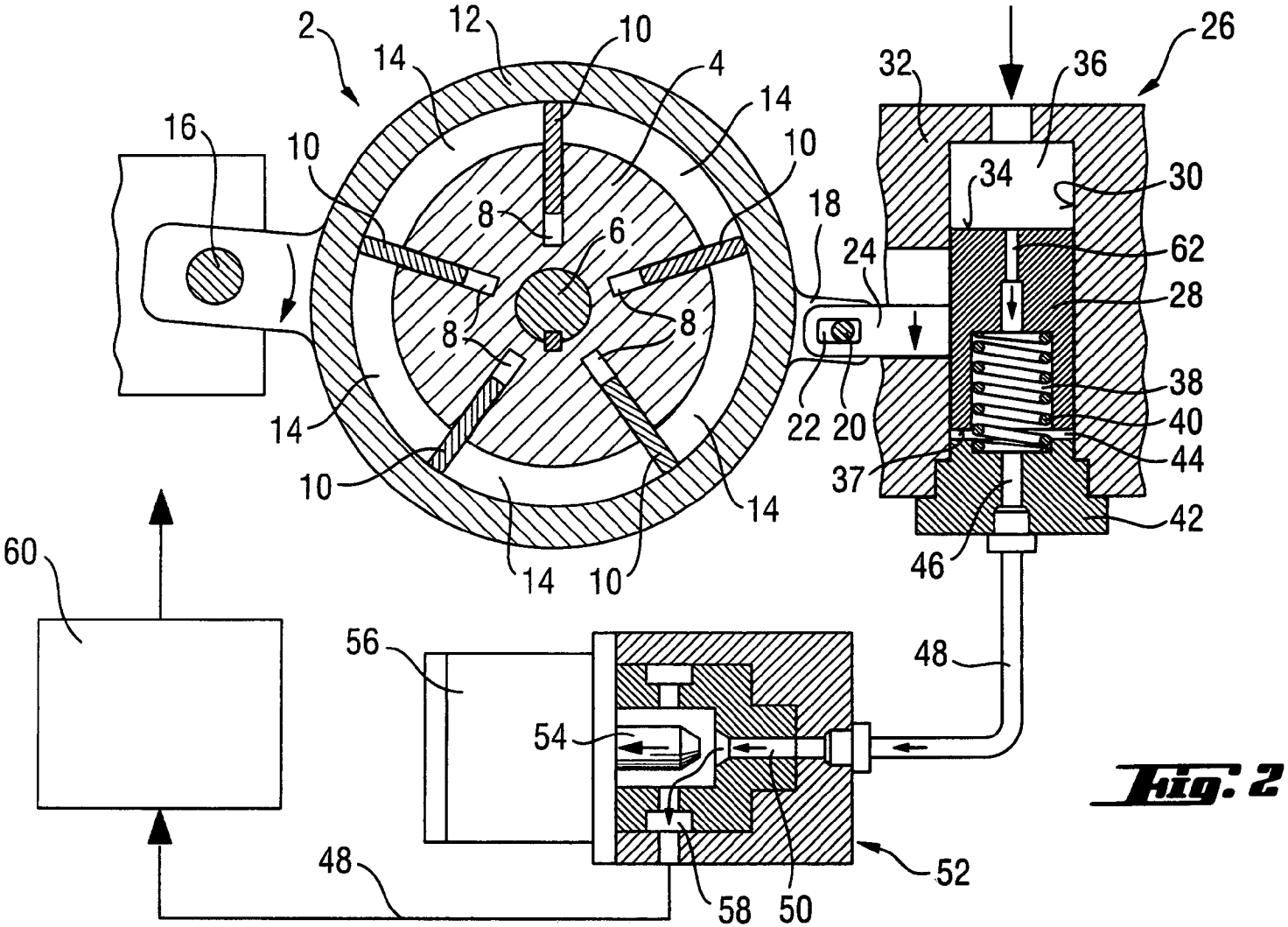
FIG. 2 is a view of the system in a second operating position.

The vane cell pump 2 schematically illustrated in FIGS. 1 and 2 has a rotor 4 which is non-rotatably connected with a drive shaft 6. In the rotor 4, recesses 8 are provided which extend radially to the outside and in which longitudinally displaceable rotor blades 10 are received in a known manner. The rotor 4 and the rotor blades 10 received therein are surrounded by a lifting ring 12, so that corresponding oil delivery spaces 14 are constructed between the rotor 4, the lifting ring 12 and between two respectively adjacent rotor blades 10. The lifting ring 12 is swivellably about an axis 16 disposed on a housing-fixed point. As a result, its position is unchanged with respect to the axis of rotation of the rotor for adjusting a defined oil delivery quantity per rotation. For this purpose, the lifting ring 12 has a linked tongue 18 which is situated opposite the bearing axis 16 and which is equipped with a guiding pin 20 interacting in the manner of a connecting link guide with a link window 22 of an adjusting rod 24. The adjusting rod 24 is linked to the outer circumference of an adjusting piston 28 guided in a pressure regulating valve 26.

Between the housing 32 and the piston front side 34, a first pressure chamber 36 is formed which is connected with the delivery side of the vane cell pump 2. On the piston rear side 37, a receiving opening 38 is provided in the adjusting piston 28, in which receiving opening 38, a flat coil spring 40 is accommodated or guided. On one its ends, the flat coil spring 40 is supported at the bottom of the of the piston rear side 37 and, on its other end, the flat coil spring 40 is supported at a closing element 42 of the pressure regulating valve 26. Between the closing element 42 and the piston rear side, a second pressure chamber 44 is constructed which is connected with the input 50 of a regulating valve 52 by way of an opening 42 provided in the closing element 46 and a hydraulic pipe 48 connected thereto. The input 50 of the regulating valve 52 is monitored by an adjusting piston 54 which is controlled by a solenoid 56 provided at the regulating valve 52. The output 58 of the regulating valve 52 is connected with the oil tank or the oil reservoir 60 of the internal-combustion engine into which the suction side of the vane cell pump 2 leads, in turn. The two pressure chambers 36 and 44 constructed in the pressure regulating valve 26 are connected by way of a throttle which is constructed in the adjusting piston 28 and which, in the present embodiment, is a stepped bore 62.

Figure 3:
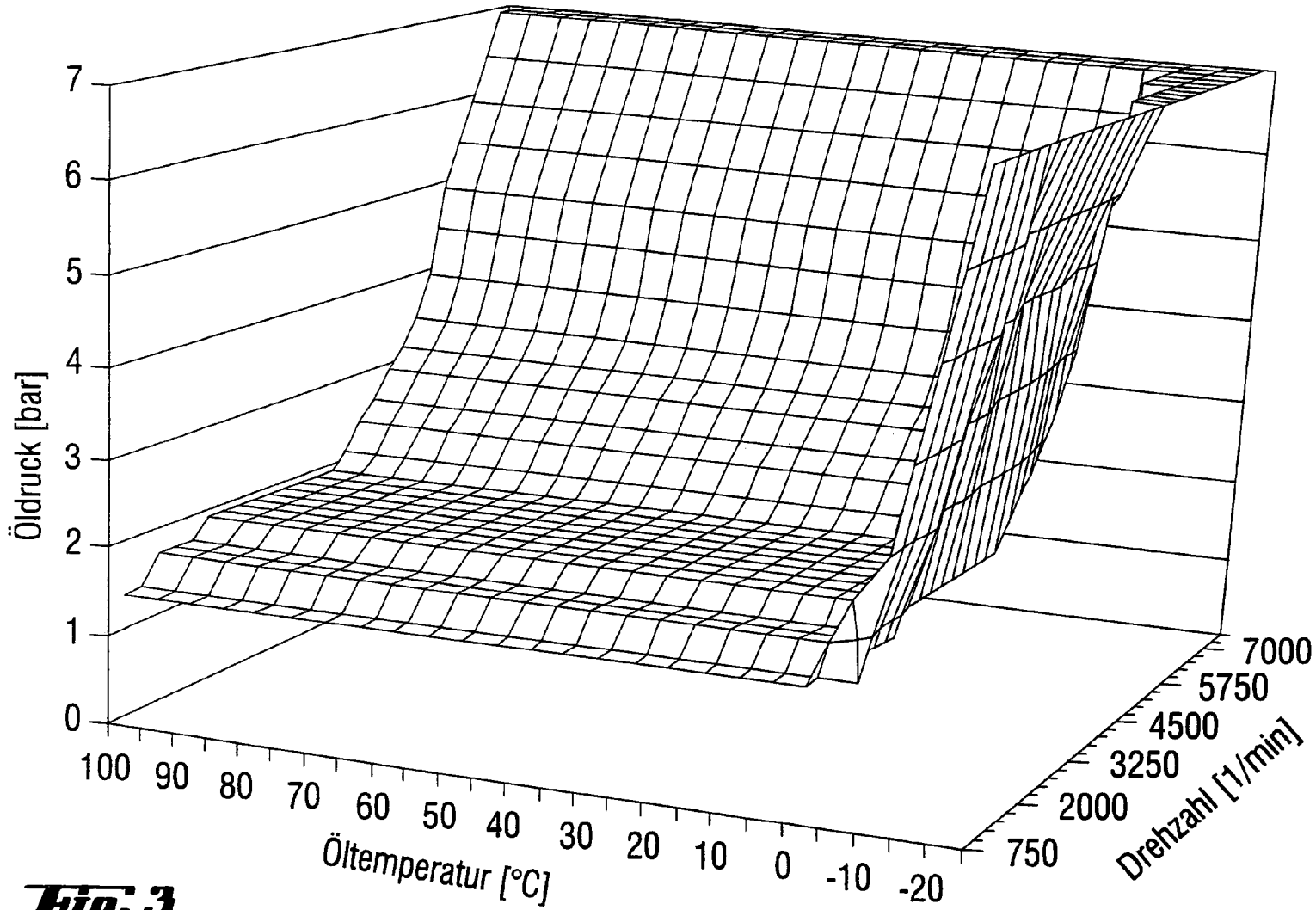
FIG. 3 is a graphic representation of an operating-point-dependent oil pressure control.

In the following, the method of operation of the system for controlling the pumping capacity of the vane cell pump will be explained in detail. As a function of operating parameters, which will be explained in detail by means of the control diagram in FIG. 3, the vane cell pump, which is rigidly driven by the engine of the internal-combustion engine, delivers a defined oil volume flow to the consuming devices of the internal-combustion engine. In this case, the pressure chamber 36 of the pressure regulating valve 26 is connected with the delivery side of the vane cell pump 2. As a function of the oil pressure existing in the first pressure chamber 36, the position of the lifting ring 12 relative to the axis of rotation of the rotor and thus the oil delivery quantity per rotation of the rotor are adjusted. As a result, as generally known, the oil volume flow delivered by the vane cell pump 2 is adjusted continuously between a maximal delivery quantity (see FIG. 1) and a zero delivery quantity (see FIG. 2). As explained initially, by means of the controlling of the pressure regulating valve 26 explained in detail in the following, for a further reduction of the taken-up driving power of the vane cell pump 2, as a function of operating parameters, such as the rotational speed, the oil temperature or the load condition of the internal-combustion engine, the oil delivery quantity and thus the oil pressure can be adapted for reducing the taken-up driving power. The adjusting piston 54 of the regulating valve 52 is controlled by way of a characteristic curve diagram stored in the engine control unit. In the position of the adjusting piston 54 illustrated in FIG. 1, the input 50 of the regulating valve 52 is completely closed. As a result, the pressure in the first and in the second pressure chamber 36, 44 is the same, so that, because of the flat coil spring 40, the adjusting piston 28 takes up a position within the valve bore 30, in which the eccentricity of the position of the lifting ring 12 relative to the axis of rotation of the vane cell pump 2 is maximal. When the adjusting piston 54 opens up the input 50 (see FIG. 2), a certain oil volume flow flows via the stepped bore 62 by way of the hydraulic pipe 48 to the oil reservoir 60 and thus flows off to the suction side of the vane cell pump 2. As a result of the throttling effect of the stepped bore 62, a differential pressure is generated between the piston front and rear side 34, 37, so that the pressure in the second pressure chamber 44 is lowered with respect to that in the first pressure chamber 36. Thus, the adjusting characteristic of the adjusting piston 28 changes and the latter, as illustrated in FIG. 2, is moved against the force of the flat coil spring 40 in the direction of the closing element 42. As a result, by way of the adjusting rod 24 and the linked tongue 18, the position of the lifting ring 12 relative to the axis of rotation of the rotor is changed such that the oil delivery quantity of the vane cell pump 2 and thus the oil pressure is reduced. Corresponding to the characteristic curve diagram which is illustrated in FIG. 3 and filed in the engine control unit, as a function of the oil temperature and the rotational speed of the internal-combustion engine, arbitrary oil volume flows can be adjusted which are adapted to the corresponding oil pressure demand of the engine. Thus, for example, at low rotational speeds, a clearly lower oil pressure is required for a sufficient bearing supply than at high rotational speeds. Extremely high or low oil temperatures require a higher oil pressure in order to, on the one hand, meet the higher cooling requirement of the bearings and, on the other hand, be able to compensate the pipe pressure loss and the bearing intake pressure at low oil temperatures. Furthermore, in the case of a high load condition of the engine signalled by the position of the throttle valve, a higher oil pressure is required than at lower and medium loads.

In the case of engines using cooling jet nozzles for the piston cooling, which nozzles open at a certain threshold oil pressure, it now becomes possible to control the piston jet nozzles by way of the characteristic diagram filed in the engine control unit. Additionally, the friction losses are reduced thereby and the delivery flow required for supplying the engine is reduced.

Figure 4:
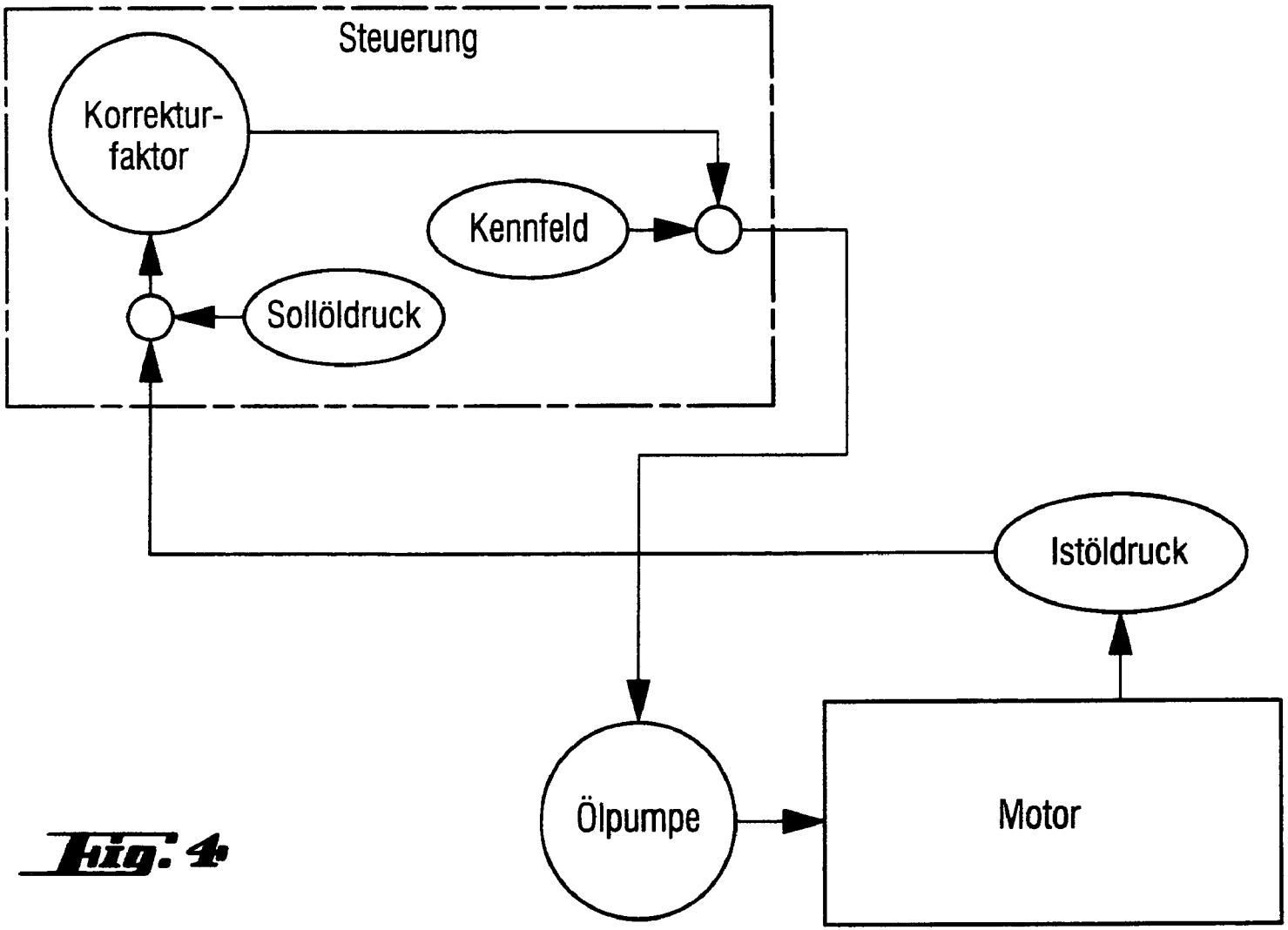
FIG. 4 is a block diagram for a calibrated oil pressure control.

In connection with the suggested operating-point-dependent oil pressure control, a self-calibration is also provided. As illustrated by means of FIG. 4, the desired oil pressure is compared in this case with the actual oil pressure. If the actual oil pressure deviates from the desired oil pressure by a previously defined $\Delta p$, the control curve is shifted by a correction factor until the $\Delta p$ corresponds to the defined criterion. Background for the provided self-calibration is the fact that the oil demand of the engine changes during its service life as a result of a bearing wear, a pump wear or a changing oil viscosity.

The invention claimed is:

1. A system for controlling the pumping capacity of a lubricant pump for an internal-combustion engine, comprising: a vane cell pump including a rotor body with rotor blades radially displaced in the rotor body and a lifting ring whose position is adjustable with respect to the axis of rotation of the rotor to change an oil delivery volume as a function of operating parameters of the internal-combustion engine, an adjusting piston operatively linked to said lifting ring, and guided in a valve bore of a pressure regulating valve, wherein said adjusting piston is acted upon by engine oil pressure on a piston front side with the piston front side being connected with the piston rear side by way of a throttle bore in the adjusting piston;

a pressure chamber on the adjusting piston rear side in which a spring element is located; and a hydraulic pipe connected to the pressure chamber and via a regulating valve to a suction side of the lubricant pump such that a delivery volume of the vane cell pump is variable as a function of an oil volume flow though the throttle bore, wherein, for an operating-point-dependent oil pressure control of the vane cell pump, a characteristic curve diagram is stored in a control unit, by means of which characteristic curve diagram, the oil pressure is defined as a function of the rotational speed, the engine oil temperature or the load condition of the internal-combustion engine.

2. The system according to claim 1, wherein the adjusting piston rear side has a receiving opening in which the spring element is at least partially guided and supported.

3. The system according to claim 1, wherein the regulating valve arranged in the hydraulic pipe provides for adjustment of oil flow to be returned to a suction side of the vane cell pump.

4. The system according to claim 3, wherein the operating parameters of the internal-combustion engine include at least one of rotational speed, load and engine oil temperature.

5. The system according to claim 1, wherein the characteristic curve diagram is calibrated by a correction factor.

6. A system for controlling the pumping capacity of a lubricant pump for an internal-combustion engine, comprising: a vane cell pump including a rotor body with rotor blades radially displaced in the rotor body and a lifting ring whose position is adjustable with respect to the axis of rotation of the rotor to change an oil delivery volume as a function of operating parameters of the internal-combustion engine, an adjusting piston operatively linked to said lifting ring, and guided in a valve bore of a pressure regulating valve, wherein said adjusting piston is acted upon by engine oil pressure on a piston front side with the piston front side being connected with the piston rear side by way of a throttle bore in the adjusting piston;

a pressure chamber on the adjusting piston rear side in which a spring element is located; and a hydraulic pipe connected to the pressure chamber and via a regulating valve to a suction side of the lubricant pump such that a delivery volume of the vane cell pump is variable as a function of an oil volume flow though the throttle bore, wherein the adjusting piston rear side has a receiving opening in which the spring element is at least partially guided and supported, wherein, for an operating-point-dependent oil pressure control of the vane cell pump, a characteristic curve diagram is stored in a control unit, by means of which characteristic curve diagram, the oil pressure is defined as a function of the rotational speed, the engine oil temperature or the load condition of the internal-combustion engine.

7. A system for controlling the pumping capacity of a lubricant pump for an internal-combustion engine, comprising: a vane cell pump including a rotor body with rotor blades radially displaced in the rotor body and a lifting ring whose position is adjustable with respect to the axis of rotation of the rotor to change an oil delivery volume as a function of operating parameters of the internal-combustion engine, an adjusting piston operatively linked to said lifting ring, and guided in a valve bore of a pressure regulating valve, wherein said adjusting piston is acted upon by engine oil pressure on a piston front side with the piston front side being connected with the piston rear side by way of a throttle bore in the adjusting piston;

a pressure chamber on the adjusting piston rear side in which a spring element is located; and a hydraulic pine connected to the pressure chamber and via a regulating valve to a suction side of the lubricant pump such that a delivery volume of the vane cell pump is variable as a function of an oil volume flow though the throttle bore, wherein the regulating valve arranged in the hydraulic pipe provides for adjustment of oil flow to be returned to a suction side of the vane cell pump, wherein, for an operating-point-dependent oil pressure control of the vane cell pump, a characteristic curve diagram is stored in a control unit, by means of which characteristic curve diagram, the oil pressure is defined as a function of the rotational speed, the engine oil temperature or the load condition of the internal-combustion engine.

8. A system for controlling the pumping capacity of a lubricant pump for an internal-combustion engine, comprising: a vane cell pump including a rotor body with rotor blades radially displaced in the rotor body and a lifting ring whose position is adjustable with respect to the axis of rotation of the rotor to chance an oil delivery volume as a function of operating parameters of the internal-combustion engine, an adjusting piston operatively linked to said lifting ring, and guided in a valve bore of a pressure regulating valve, wherein said adjusting piston is acted upon by engine oil pressure on a piston front side with the piston front side being connected with the piston rear side by way of a throttle bore in the adjusting piston;

a pressure chamber on the adjusting piston rear side in which a spring element is located; and a hydraulic pipe connected to the pressure chamber and via a regulating valve to a suction side of the lubricant pump such that a delivery volume of the vane cell pump is variable as a function of an oil volume flow though the throttle bore, wherein the operating parameters of the internal-combustion engine include at least one of rotational speed, load and engine oil temperature, wherein, for an operating-point-dependent oil pressure control of the vane cell pump, a characteristic curve diagram is stored in a control unit, by means of which characteristic curve diagram, the oil pressure is defined as a function of the rotational speed, the engine oil temperature or the load condition of the internal-combustion engine.

* * * * *